US011713531B2

(12) United States Patent
White et al.

(10) Patent No.: US 11,713,531 B2
(45) Date of Patent: Aug. 1, 2023

(54) METHOD AND APPARATUS FOR CLEANING LAUNDRY

(71) Applicant: Electrolux Appliances Aktiebolag, Stockholm (SE)

(72) Inventors: Allison White, Charlotte, NC (US); Yihong Li, Charlotte, NC (US); Oscar Madalena, Charlotte, NC (US)

(73) Assignee: Electrolux Appliances Aktiebolag

( * ) Notice: Subject to any disclaimer, the term of this patent is extended or adjusted under 35 U.S.C. 154(b) by 237 days.

(21) Appl. No.: 17/219,142

(22) Filed: Mar. 31, 2021

(65) Prior Publication Data

US 2021/0214878 A1 Jul. 15, 2021

Related U.S. Application Data

(62) Division of application No. 16/131,912, filed on Sep. 14, 2018, now Pat. No. 11,041,267.

(51) Int. Cl.
*C11D 11/00* (2006.01)
*C11D 17/04* (2006.01)
(Continued)

(52) U.S. Cl.
CPC ..... *D06F 39/028* (2013.01); *C11D 11/0017* (2013.01); *C11D 17/042* (2013.01);
(Continued)

(58) Field of Classification Search
None
See application file for complete search history.

(56) References Cited

U.S. PATENT DOCUMENTS 2,821,848 A 2/1958 Becker
2,933,912 A 4/1960 Billings
(Continued)

FOREIGN PATENT DOCUMENTS

BR 202014023113 Y1 12/2019
CN 1316109 C 5/2007
(Continued)

OTHER PUBLICATIONS

International Search Report and Written Opinion issued in International Application No. PCT/EP2014/079129, dated Mar. 23, 2015, 11 pages.
(Continued)

*Primary Examiner* — Levon J Shahinian
(74) *Attorney, Agent, or Firm* — RatnerPrestia

(57) ABSTRACT

A laundry washing machine having a casing, a washing tub within the casing, a drum within the washing tub, a door to provide access to the drum, an additive loading and supply system configured to receive one or more cleaning products, a soaking chamber configured to receive and hold a unit dose package and at least a first volume of liquid, a tub supply pipe connecting the soaking chamber to the washing tub and/or drum, valves to dispense water into the soaking chamber, and a control unit operatively connected to the valves. The control unit has instructions that, when executed: cause the valves to supply the first volume of liquid to the soaking chamber, allow the first volume of liquid to reside in the soaking chamber for a predetermined amount of time, and subsequently release the first quantity of liquid from the soaking chamber to the tub supply pipe.

10 Claims, 6 Drawing Sheets

(51) Int. Cl.

| | |
|---|---|
| ***D06F 21/04*** | (2006.01) |
| ***D06F 33/00*** | (2020.01) |
| ***D06F 33/37*** | (2020.01) |
| ***D06F 34/18*** | (2020.01) |
| ***D06F 35/00*** | (2006.01) |
| ***D06F 37/04*** | (2006.01) |
| ***D06F 37/28*** | (2006.01) |
| ***D06F 37/30*** | (2020.01) |
| ***D06F 39/02*** | (2006.01) |
| ***D06F 39/08*** | (2006.01) |
| ***D06F 39/10*** | (2006.01) |
| *D06F 103/18* | (2020.01) |
| *D06F 103/04* | (2020.01) |
| *D06F 105/42* | (2020.01) |
| *D06F 103/22* | (2020.01) |
| *D06F 103/38* | (2020.01) |

(52) U.S. Cl.

CPC ..... *D06F 21/04* (2013.01); *D06F 33/00* (2013.01); *D06F 33/37* (2020.02); *D06F 34/18* (2020.02); *D06F 37/04* (2013.01); *D06F 37/28* (2013.01); *D06F 37/304* (2013.01); *D06F 39/026* (2013.01); *D06F 39/088* (2013.01); *D06F 39/10* (2013.01); *D06F 35/006* (2013.01); *D06F 35/007* (2013.01); *D06F 2103/04* (2020.02); *D06F 2103/18* (2020.02); *D06F 2103/22* (2020.02); *D06F 2103/38* (2020.02); *D06F 2105/42* (2020.02)

(56) References Cited

U.S. PATENT DOCUMENTS

| | | | |
|---|---|---|---|
| 4,882,917 | A | 11/1989 | Mizusawa et al. |
| 5,548,978 | A | 8/1996 | Bongini et al. |
| 5,884,506 | A | 3/1999 | Blauert et al. |
| 7,036,177 | B2 | 5/2006 | Aouad et al. |
| 7,181,934 | B2 | 2/2007 | Hsu et al. |
| 8,931,311 | B2 | 1/2015 | Leibman et al. |
| 9,271,627 | B2 | 3/2016 | Alexander et al. |
| 9,574,297 | B2 | 2/2017 | Berndsen et al. |
| 9,637,857 | B2 | 5/2017 | Del Pos et al. |
| 9,663,893 | B2 | 5/2017 | Malheiros |
| 9,850,618 | B2 | 12/2017 | Burger et al. |
| 9,903,063 | B2 | 2/2018 | Carpenter et al. |
| 9,970,148 | B2 | 5/2018 | Alexander et al. |
| 9,976,246 | B2 | 5/2018 | Malheiros |
| 10,480,113 | B2 | 11/2019 | Favaro et al. |
| 10,519,590 | B2 | 12/2019 | Malheiros |
| 10,731,284 | B2 | 8/2020 | Alexander et al. |
| 10,815,607 | B2 | 10/2020 | Costa et al. |
| 2004/0088796 | A1 | 5/2004 | Neergaard et al. |
| 2004/0200245 | A1 | 10/2004 | Cheo et al. |
| 2005/0102767 | A1 | 5/2005 | Aouad et al. |
| 2005/0166645 | A1 | 8/2005 | Favret et al. |
| 2005/0229652 | A1 | 10/2005 | Kim et al. |
| 2005/0241072 | A1 | 11/2005 | Kim et al. |
| 2005/0274156 | A1 | 12/2005 | Yang |
| 2007/0130700 | A1 | 6/2007 | Cho et al. |
| 2007/0163307 | A1 | 7/2007 | Kramme et al. |
| 2007/0240456 | A1 | 10/2007 | Byun et al. |
| 2008/0295546 | A1 | 12/2008 | Cho et al. |
| 2009/0119849 | A1 | 5/2009 | Hill et al. |
| 2009/0293203 | A1 | 12/2009 | Hettinger et al. |
| 2010/0325815 | A1 | 12/2010 | Im et al. |
| 2011/0247147 | A1 | 10/2011 | Amos et al. |
| 2011/0277515 | A1 | 11/2011 | Doh |
| 2012/0060301 | A1 | 3/2012 | Kim et al. |
| 2012/0060568 | A1 | 3/2012 | Buso et al. |
| 2012/0067089 | A1 | 3/2012 | Buso et al. |
| 2012/0272691 | A1 | 11/2012 | Leibman et al. |
| 2014/0060121 | A1 | 3/2014 | Burger et al. |
| 2014/0060581 | A1 | 3/2014 | Alexander et al. |
| 2014/0060594 | A1 | 3/2014 | Alexander et al. |
| 2014/0157835 | A1 | 6/2014 | Del Pos et al. |
| 2014/0165663 | A1 | 6/2014 | Celotto et al. |
| 2015/0013075 | A1 | 1/2015 | Herrera et al. |
| 2015/0059413 | A1 | 3/2015 | Yoo et al. |
| 2015/0267340 | A1 | 9/2015 | Malheiros |
| 2015/0345069 | A1 | 12/2015 | Leibman et al. |
| 2016/0047077 | A1 | 2/2016 | Leibman et al. |
| 2016/0237612 | A1 | 8/2016 | Ghosh et al. |
| 2017/0073877 | A1 | 3/2017 | Hettinger et al. |
| 2017/0297770 | A1 | 10/2017 | Snider et al. |
| 2018/0073185 | A1 | 3/2018 | Burger et al. |
| 2018/0135226 | A1 | 5/2018 | Alexander et al. |
| 2018/0155864 | A1 | 6/2018 | Alexander et al. |
| 2019/0017208 | A1 | 1/2019 | Marangoni et al. |
| 2019/0136440 | A1 | 5/2019 | Clarke et al. |
| 2020/0370229 | A1 | 11/2020 | Bensel et al. |
| 2021/0025103 | A1 | 1/2021 | Li et al. |

FOREIGN PATENT DOCUMENTS

| | | | |
|---|---|---|---|
| DE | 7834912 | U1 | 3/1979 |
| DE | 19535203 | C1 | 10/1996 |
| DE | 19537671 | A1 | 4/1997 |
| EP | 0959171 | A1 | 11/1999 |
| EP | 1126070 | A1 | 8/2001 |
| EP | 2025798 | A2 | 2/2009 |
| EP | 2239363 | A1 | 10/2010 |
| EP | 2241669 | A1 | 10/2010 |
| EP | 2497855 | A1 | 9/2012 |
| EP | 3037582 | A1 | 6/2016 |
| EP | 3184688 | A1 | 6/2017 |
| EP | 3257998 | A1 | 12/2017 |
| EP | 3293302 | A1 | 3/2018 |
| EP | 2540902 | B1 | 5/2020 |
| EP | 3660198 | A1 | 6/2020 |
| FR | 1209601 | A | 3/1960 |
| GB | 586424 | | 3/1947 |
| GB | 589374 | | 6/1947 |
| JP | 2016073330 | A | 5/2016 |
| KR | 101215448 | B1 | 12/2012 |
| WO | 2005059229 | A1 | 6/2005 |
| WO | 2005061685 | A1 | 7/2005 |
| WO | 2007051988 | A1 | 5/2007 |
| WO | 2015197109 | A1 | 12/2015 |
| WO | 2016101994 | A1 | 6/2016 |
| WO | 2016102005 | A1 | 6/2016 |

OTHER PUBLICATIONS

International Search Report and Written Opinion issued in International Application No. PCT/EP2014/079176, dated Mar. 9, 2015, 9 pages.

International Preliminary Report on Patentability issued in International Application No. PCT/EP2014/079176, dated Jun. 27, 2017, 7 pages.

USPTO Notice of Allowance issued in U.S. Appl. No. 15/537,701, dated May 19, 2020, 9 pages.

International Search Report and Written Opinion issued in International Application No. PCT/IB2019/000746, dated Jun. 25, 2020, 18 pages.

International Search Report and Written Opinion issued in International Application No. PCT/EP2017/072466, dated Nov. 10, 2017—11 pages.

International Search Report and Written Opinion issued in International Application No. PCT/EP2020/068875, dated Sep. 22, 2020, 11 pages.

USPTO Non Final Office Action issued in U.S. Appl. No. 16/131,935, dated Jan. 25, 2021, 14 pages.

USPTO Notice of Allowance issued in U.S. Appl. No. 16/131,757, dated Jan. 25, 2021, 8 pages.

USPTO Non Final Office Action issued in U.S. Appl. No. 16/131,757, dated Apr. 1, 2020, 17, pages.

USPTO Non Final Office Action issued in U.S. Appl. No. 16/131,921, dated Dec. 22, 2020, 32 pages.

(56) References Cited

OTHER PUBLICATIONS

International Search Report and Written Opinion for International Application No. PCT/EP2020/071064, dated Nov. 9, 2020, 14 pages.
USPTO Final Office Action issued in U.S. Appl. No. 16/131,757, dated Aug. 6, 2020, 15 pages.
International Search Report and Written Opinion for International Application No. PCT/EP2019/072846, dated Oct. 22, 2019, 11 pages.
USPTO Non Final Office Action issued in U.S. Appl. No. 16/131,757, dated Oct. 16, 2020, 20 pages.
USPTO Non Final Office Action issued in U.S. Appl. No. 16/522,156, dated Feb. 10, 2021, 46 pages.
USPTO Notice of Allowance issued in U.S. Appl. No. 16/131,912, dated Feb. 22, 2021, 14 pages.
USPTO Non Final Office Action issued in U.S. Appl. No. 16/131,912, dated Aug. 19, 2020, 19 pages.
USPTO otice of Allowance issued in U.S. Appl. No. 16/131,912, dated Dec. 9, 2020, 17 pages.
USPTO Final Office Action issued in U.S. Appl. No. 16/131,935, dated Mar. 18, 2021, 21 pages.
USPTO Notice of Allowance issued in U.S. Appl. No. 16/131,757, dated Mar. 17, 2021, 30 pages.
USPTO Final Office Action issued in U.S. Appl. No. 16/131,921, dated Mar. 19, 2021, 28 pages.
USPTO Notice of Allowance issued in U.S. Appl. No. 16/332,116, dated Mar. 19, 2021, 23 pages.
Notice of Allowance for U.S. Appl. No. 16/822,637, dated Aug. 22, 2022, 7 pages.
USPTO Non Final Office Action issued in U.S. Appl. No. 16/131,921, dated Apr. 30, 2021, 16 pages.
USPTO Final Office Action for U.S. Appl. No. 16/822,637, dated May 9, 2022, 27 pages.
Brazilian Written Opinion issued in Brazilian Application No. 112019003786-1, dated Jun. 23, 2021, 4 pages.
USPTO Notice of Allowance issued in U.S. Appl. No. 16/131,935, dated Jun. 29, 2021, 10 pages.
USPTO Notice of Allowance issued in U.S. Appl. No. 16/131,935, dated Jun. 24, 2021, 12 pages.
USPTO Non Final Office Action for U.S. Appl. No. 17/128,947, dated Mar. 2, 2022, 9 pages.
USPTO Final Office Action issued in U.S. Appl. No. 16/822,728, dated Jul. 12, 2022, 24 pages.
Non Final Office Action for U.S. Appl. No. 16/822,728, dated Oct. 24, 2022, 12 pages.
Notice of Allowance for U.S. Appl. No. 17/171,193, dated Oct. 25, 2022, 10 pages.
USPTO Non Final Office Action for U.S. Appl. No. 17/541,941, dated Mar. 14, 2022, 11 pages.
Non Final Office Action for U.S. Appl. No. 17/128,947, dated Mar. 22, 2023, 13 pages.
Final Office Action for U.S. Appl. No. 16/822,728, dated Apr. 7, 2023, 15 pages.
Non Final Office Action for U.S. Appl. No. 17/054,667, dated May 1, 2023, 11 pages.

METHOD AND APPARATUS FOR CLEANING LAUNDRY

CROSS REFERENCE TO RELATED APPLICATION

This application is a Divisional Application of U.S. patent application Ser. No. 16/131,912, filed Sep. 14, 2018. The contents of this application are incorporated herein by reference.

TECHNICAL FIELD

The present invention concerns the field of laundry washing machines and fabric cleaning techniques, and particularly to machines and techniques using unit dose packages for detergent or other compositions.

BACKGROUND

The use of automated laundry washing machines is widespread. Such machines include both relatively simple laundry washing machines that can only wash and rinse laundry, and more complex laundry washing machines that can also dry laundry. The term "laundry washing machine" is used herein to refer to both types of laundry washing machine, and other laundry washing machines as may be known or later made available.

Laundry washing machines typically use a liquid solution to help remove soil from fabrics. The liquid solution usually is water-based, and may comprise water alone, or water mixed with additives (e.g., detergent, fabric softener, bleach, etc.). The cleaning solution may be provided at a variety of different temperatures.

A laundry washing machine typically includes a tub configured to receive and hold the cleaning solution and a drum rotatably mounted inside the tub to receive and hold fabric laundry products, such as clothing, bed sheets and other linens, curtains, and the like. The drum is perforated or otherwise configured to allow cleaning solution to pass between the tub and the drum. In "front-loading" washing machines, the drum rotates on a horizontal or nearly horizontal axis, and the cleaning solution is provided in the lower end of the tub, and as the drum rotates, the laundry is repeatedly raised and lowered into and out of the cleaning solution. In "top-loading" washing machines, the drum rotates on a vertical or nearly vertical axis, and the cleaning solution is provided, during the wash phase, at a level at which the laundry is immersed within the solution. The drum may be reciprocated back and forth to agitate the laundry and cleaning solution, or the drum may remain still while a separate agitator located inside the drum moves to perform the agitation.

The laundry washing machine may have a number of operation programs, which may be selected by the user or selected automatically based on detected conditions (e.g., load weight). In a typical wash phase, the laundry washing machine may determine the amount of wash water and rinse water according to a user's selection of a particular washing program, and then proceed to supply the appropriate amount of cleaning solution to the tub, operate the drum, and otherwise control the laundry washing machine components to execute the selected washing program.

Laundry washing machine additives may be provided in various forms, such as loose powder, liquid and gel. It is also known to provide additives in the form of a unit dose package (also known as a "UDP" or "pod"). The UDP typically comprises a pre-measured amount of treating agent, such as detergent, incorporated into a water-soluble pouch. The detergent may be, for example powder, liquid, paste, waxy or gel compositions, and the pouch typically comprises a water-soluble film. In some cases, the pouch may have multiple compartments containing different compositions. Suitable pouch materials can vary, but they typically comprise polymeric materials, copolymers, or mixtures of materials.

UDPs can be inserted directly into the laundry washing machine drum with the laundry load. However, the Applicants have found that UPDs provided in this way can suffer from various drawbacks.

One drawback is that the UDP might be dissolved only partially. For example, the UDP can become trapped within the laundry in a way that it is only partially-dissolved, which can lead to incomplete or inefficient cleaning and the formation of spots or stains on the laundry. The UDP also can become trapped in or on the bellows seal that surrounds the drum door, again leading to incomplete or inefficient cleaning. The Applicants have also found that pieces of undissolved UDP pouches often remain in the laundry or in the bellows.

A further drawback that the Applicants have identified is that the UDP can be loaded into the drum and dissolved to release the active ingredients before the washing cycle effectively begins. For example, a UDP may be loaded into the drum and begin dissolving in water present within the drum or in the clothing being cleaned. Then, if the washing cycle starts with a draining phase, which is typically performed for safety and/or hygienic reasons at the very beginning of the cycle, some of all of the active ingredients of the UDP may be flushed away during the initial draining phase.

Another drawback can occur if the washing cycle begins after a delay following insertion of the UDP. In such cases, the UDP may break down or its pouch may dissolve before the washing cycle begins, resulting on undesired spots or stains on the laundry due to contact of the highly concentrated detergent emitted from the UDP with the load of laundry. When this happens, the detergent also may fall to the bottom of the drum and be washed away during an initial draining cycle.

Still another drawback the Applicants have identified is that the effective time of breakage of the UDP and the release of detergent cannot be accurately predicted. Thus, the cleaning cycle cannot be optimized to provide the desired duration of contact between the detergent and the laundry.

The Applicants have developed alternative laundry washing machines that address these drawbacks. For example, the Applicants have provided a laundry washing machine that is configured to receive a UDP in a multipurpose additive dispenser compartment (i.e., within a dispenser drawer with compartments that receives detergent and other additives) having adjacent water inlets that are configured to shape the incoming liquid as a jet that can wet and pierce the UDP's water-soluble outer pouch. In this device, the UDP may be conveniently loaded into a compartment in a dispenser that can alternatively receive loose powdered detergent for the main wash phase, and the water jets break open the UDP while it is still in the drawer compartment. This provides more predictable dissolution of the detergent and the opportunity for improved cleaning. While such configurations have been successful and effective, the Applicants have determined that they have possible shortcomings. For example, the water jets that are supposed to break open the UDP pouch may be located in a fluid line having an air break that prevents reverse flow and siphoning, and this air break can limit the amount of hydraulic pressure available to create an effective water jet. In other cases, no air break may be in the water line, but the water pressure provided at the installation location may be insufficient to provide a water jet that can reliably break open different UDPs.

As another example, the Applicants have provided a system in which the UDP can be flushed from a multipurpose additive drawer to a sump located below the tub, where the UDP's contents mix with the water to provide a more dilute and uniform cleaning solution before being deposited on the laundry. This does not rely on the UDP being actively broken apart be water jets in the drawer, but instead relies on conventional dissolution of the UDP's water-soluble outer membrane. However, the Applicants have determined that relying on such dissolution can have shortcomings. For example, different UDP compositions may take different amounts of time to passively dissolve, and the overall time of the wash cycle may need to be increased to accommodate such passive dissolution to ensure complete mixing of the detergent.

As a result of the Applicant's study of its earlier works, the Applicant has determined that there is a need to provide alternative configurations for laundry washing machine UDP loading and processing systems.

This description of the background is provided to assist with an understanding of the following explanations of exemplary embodiments, and is not an admission that any or all of this background information is necessarily prior art.

SUMMARY

In one exemplary aspect, there is provided a laundry washing machine having a casing, a washing tub located within the casing, a drum mounted within the washing tub and configured to rotate relative to the casing, a door attached to the casing and being openable to provide access to the drum, an additive loading and supply system configured to receive one or more cleaning products therein, a soaking chamber configured to receive and hold a unit dose package and at least a first volume of liquid, the unit dose package comprising a water soluble pouch containing a dose of cleaning product, a tub supply pipe fluidly connecting an outlet of the soaking chamber to the washing tub, one or more water supply valves configured to dispense water into the soaking chamber, and a control unit operatively connected to the one or more water supply valves. The control unit has instructions that, when executed: cause the one or more supply valves to supply the first volume of liquid to the soaking chamber, allow the first volume of liquid to reside in the soaking chamber for a predetermined amount of time, and release the first quantity of liquid from the soaking chamber to the tub supply pipe after the predetermined amount of time has elapsed.

The additive loading and supply system may have an openable receptacle, and the soaking chamber may be located in the additive loading and supply system. The soaking chamber may be a siphon chamber having a siphon tube fluidly connected to the outlet of the siphon chamber. The instructions to release the first quantity of liquid from the soaking chamber to the tub supply pipe may include instructions to cause the one or more supply valves to supply a second volume of liquid to the soaking chamber, the second volume of liquid being sufficient to cause a level of liquid in the soaking chamber to reach the siphon outlet tube to cause the first volume of liquid and the second volume of liquid to siphon out of the soaking chamber and into the tub supply pipe.

A heater or an agitator may be provided and configured to stir the contents of the soaking chamber.

The tub supply pipe may have a first portion fluidly connecting an outlet of the additive loading and supply system to an inlet of the soaking chamber, and a second portion fluidly connecting the outlet of the soaking chamber to at least one of the washing tub and the drum, and the first portion of the tub supply pipe may be dimensioned to allow an unbroken unit dose package to pass from the additive loading and supply system to the soaking chamber. The second portion of the tub supply pipe may be dimensioned to not allow an unbroken unit dose package to pass from the additive loading and supply system to the soaking chamber. In this example, the soaking chamber may be a siphon chamber having a siphon tube fluidly connected to the outlet of the siphon chamber, and the instructions to release the first quantity of liquid from the soaking chamber to the tub supply pipe may include instructions to cause the one or more supply valves to supply a second volume of liquid to the soaking chamber, the second volume of liquid being sufficient to cause a level of liquid in the soaking chamber to reach the siphon outlet tube to cause the first volume of liquid and the second volume of liquid to siphon out of the soaking chamber and into the tub supply pipe. Such a siphon chamber may be received in a receptacle in the laundry washing machine, the receptacle being separate from the additive loading and supply system.

The soaking chamber may be a receptacle that is movable between a first position in which the receptacle is oriented to hold the unit dose package and the first volume of fluid, and a second position in which the receptacle is oriented to allow the contents of the receptacle to fall into the second portion of the tub supply pipe. Such receptacle may be rotatable about a pivot axis, and the instructions to release the first quantity of liquid from the soaking chamber to the tub supply pipe comprise instructions to cause the one or more supply valves to supply a second volume of liquid to the soaking chamber, the second volume of liquid being sufficient to cause the receptacle to pivot about the pivot axis to cause the first volume of liquid and the second volume of liquid to pour out of the receptacle chamber and into the tub supply pipe. Alternatively, such receptacle may be rotatable about a pivot axis, and the instructions to release the first quantity of liquid from the soaking chamber to the tub supply pipe may be instructions to operate a motor to rotate the receptacle from the first position to the second position.

The tub supply pipe may include a first portion, a second portion located downstream of the first portion, and a valve located between the first portion and the second portion. The valve may be movable to a first position in which the valve obstructs flow through the tub supply pipe such that the first portion and the valve form the soaking chamber, and a second position in which the valve does not obstruct flow through the tub supply pipe. In such an embodiment, the instructions to cause the one or more supply valves to supply the first volume of liquid to the soaking chamber may include instructions to position the valve in the first position, and the instructions to release the first quantity of liquid from the soaking chamber to the tub supply pipe after the predetermined amount of time has elapsed may be instructions to position the valve in the second position. The valve may completely block fluid flow from the first portion of the tub supply pipe to the second portion of the tub supply pipe when the valve is in the first position.

In another exemplary aspect, there is provided a method for operating a laundry machine. The method includes receiving a unit dose package comprising a water soluble pouch containing a dose of cleaning product in a soaking chamber, providing a first quantity of liquid to the soaking chamber, allowing the first quantity of liquid and the unit dose package to reside in the soaking chamber for a predetermined amount of time, and releasing the first quantity of liquid to a tub supply pipe to flow into a washing tub after the predetermined amount of time has elapsed.

Releasing the first quantity of liquid to the tub supply pipe to flow into the washing tub after the predetermined amount of time has elapsed may include providing a second quantity of liquid to the soaking chamber, the second quantity of liquid being sufficient to cause the first quantity of liquid and the second quantity of liquid to siphon out of the soaking chamber.

Releasing the first quantity of liquid to the tub supply pipe to flow into the washing tub after the predetermined amount of time has elapsed may include providing a second quantity of liquid to the soaking chamber, the second quantity of liquid being sufficient to cause the first quantity of liquid and the second quantity of liquid to pour out of the soaking chamber.

Releasing the first quantity of liquid to the tub supply pipe to flow into the washing tub after the predetermined amount of time has elapsed may include rotating the soaking chamber to allow the first quantity of liquid and the second quantity of liquid to pour out of the soaking chamber.

Releasing the first quantity of liquid to the tub supply pipe to flow into the washing tub after the predetermined amount of time has elapsed may include opening a valve to allow the first quantity of liquid to pass from a first portion of the tub supply pipe to a second portion of the tub supply pipe.

BRIEF DESCRIPTION OF THE DRAWINGS

Embodiments of the invention will now be described, strictly by way of example, with reference to the accompanying drawings, in which.

DESCRIPTION OF EXEMPLARY EMBODIMENTS

The exemplary embodiments described herein provide apparatus and methods for introducing UDPs into laundry washing machines. The exemplary embodiments are expected to provide advancements in one or more of efficiency, convenience, cleaning effectiveness, or other performance aspects for laundry washing machines, but the invention is not intended to be limited to any particular performance benchmark requirements.

Exemplary embodiments are described in the context of certain laundry washing machines, as described below. It will be understood that the laundry machines, may be regular washing machines or combined washing-drying machines. However, it will be understood that embodiments of the inventions are not limited to the particular structures or features of the described laundry washing machines, and that embodiments of the inventions may be conveniently applied to other types of laundry cleaning equipment. Such modifications will be understood by persons of ordinary skill in the art in view of the teachings provided herein.

Figure 1:
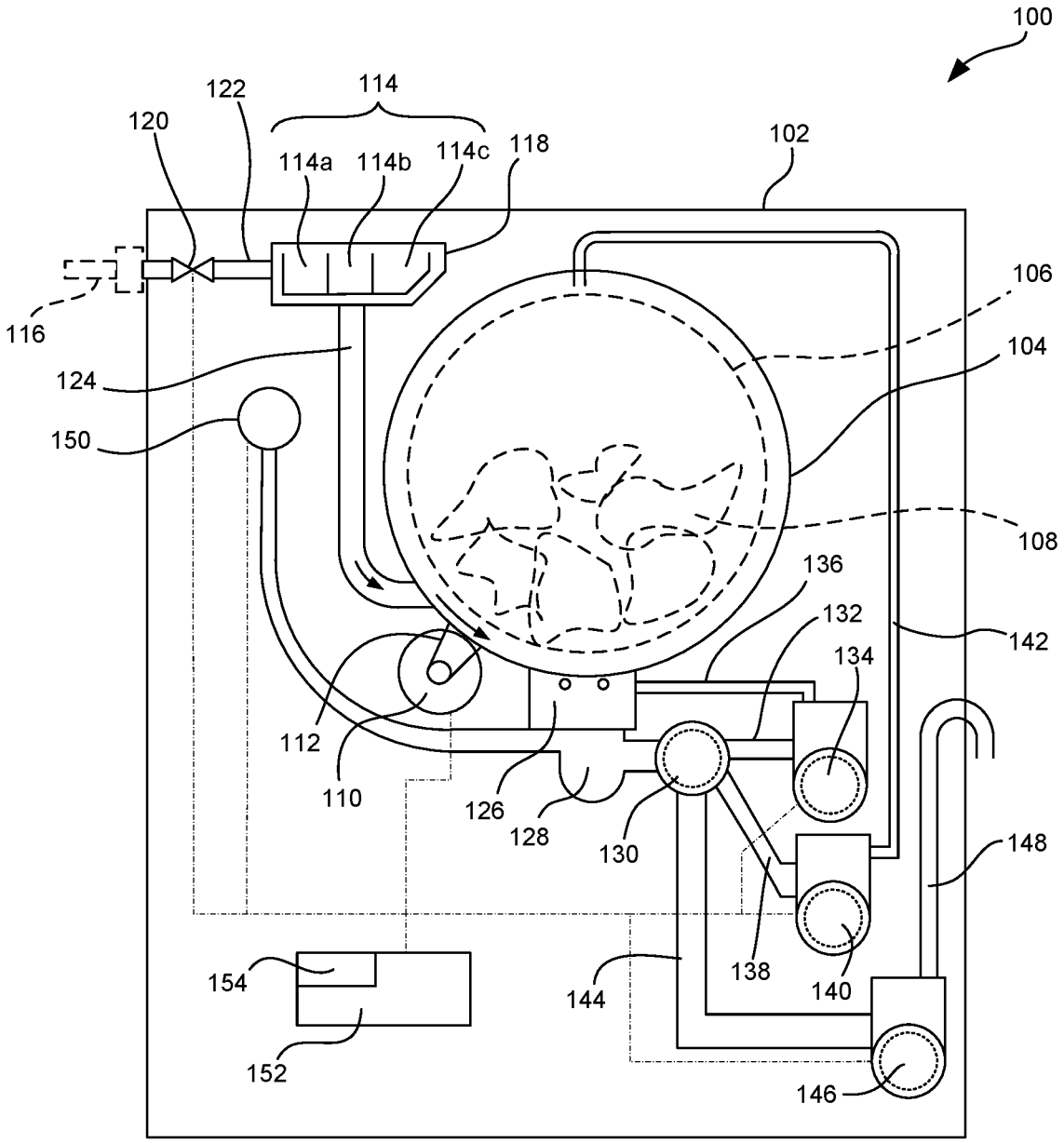
FIG. 1 is a schematic illustration of a laundry washing machine.
Figure 3:
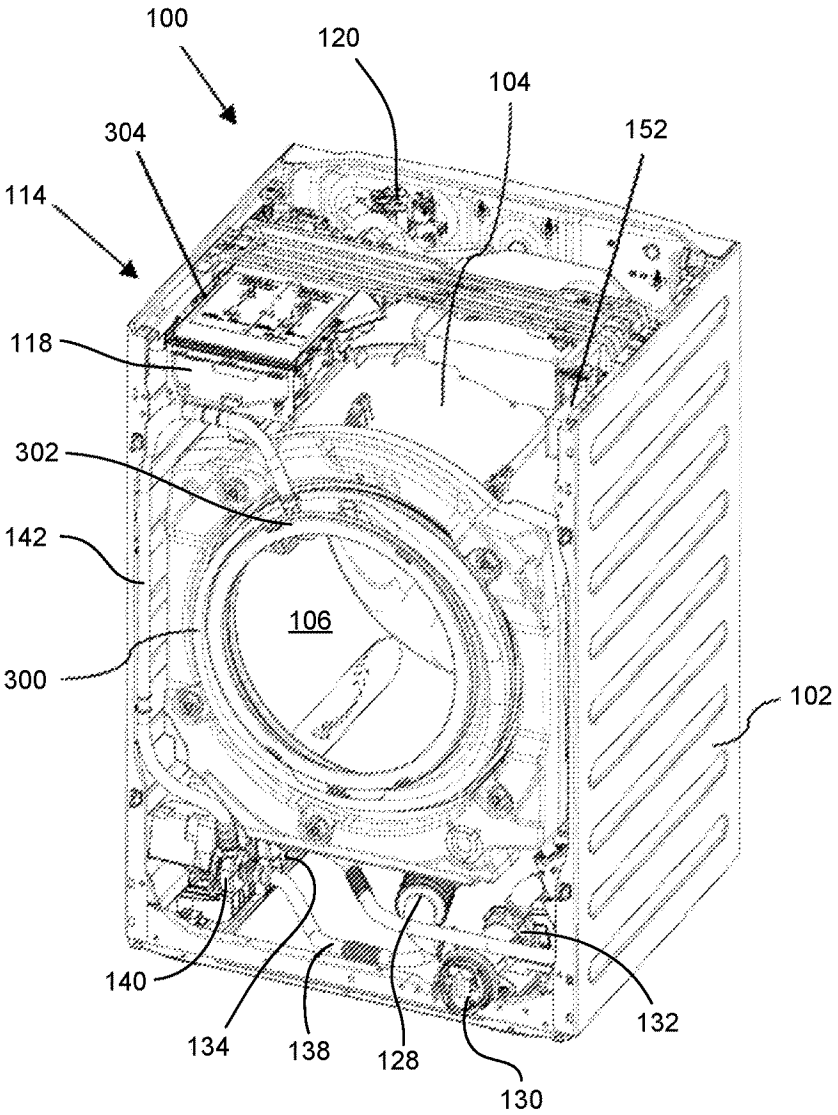
FIG. 3 is an isometric view of the laundry washing machine of FIG. 2, shown with the door, top and front panels removed to illustrate interior components.
Figure 2:
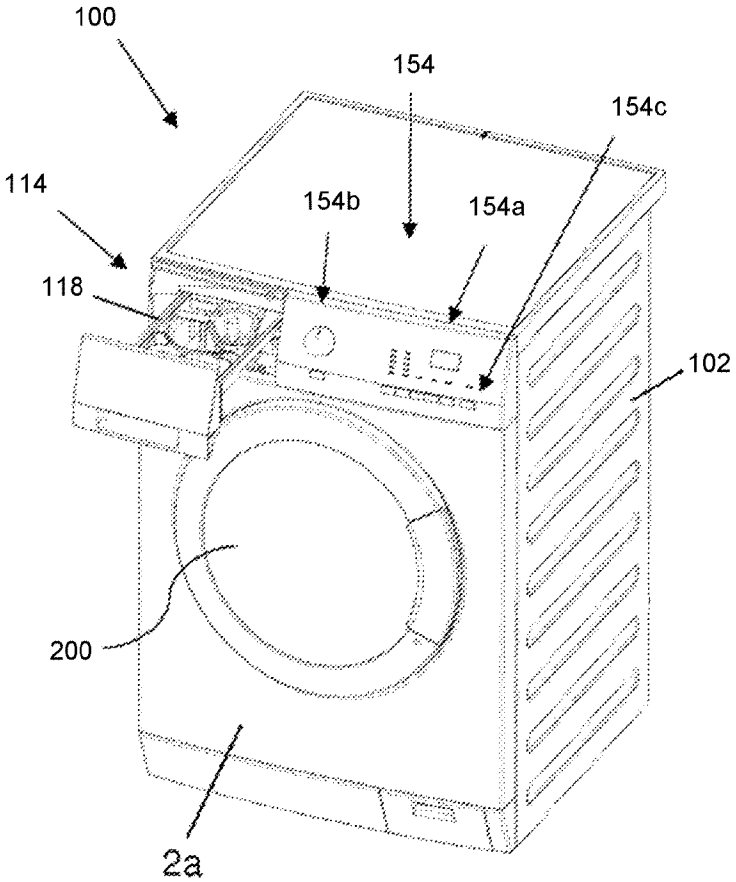
FIG. 2 is an isometric view of an exemplary laundry washing machine.
Figure 4:
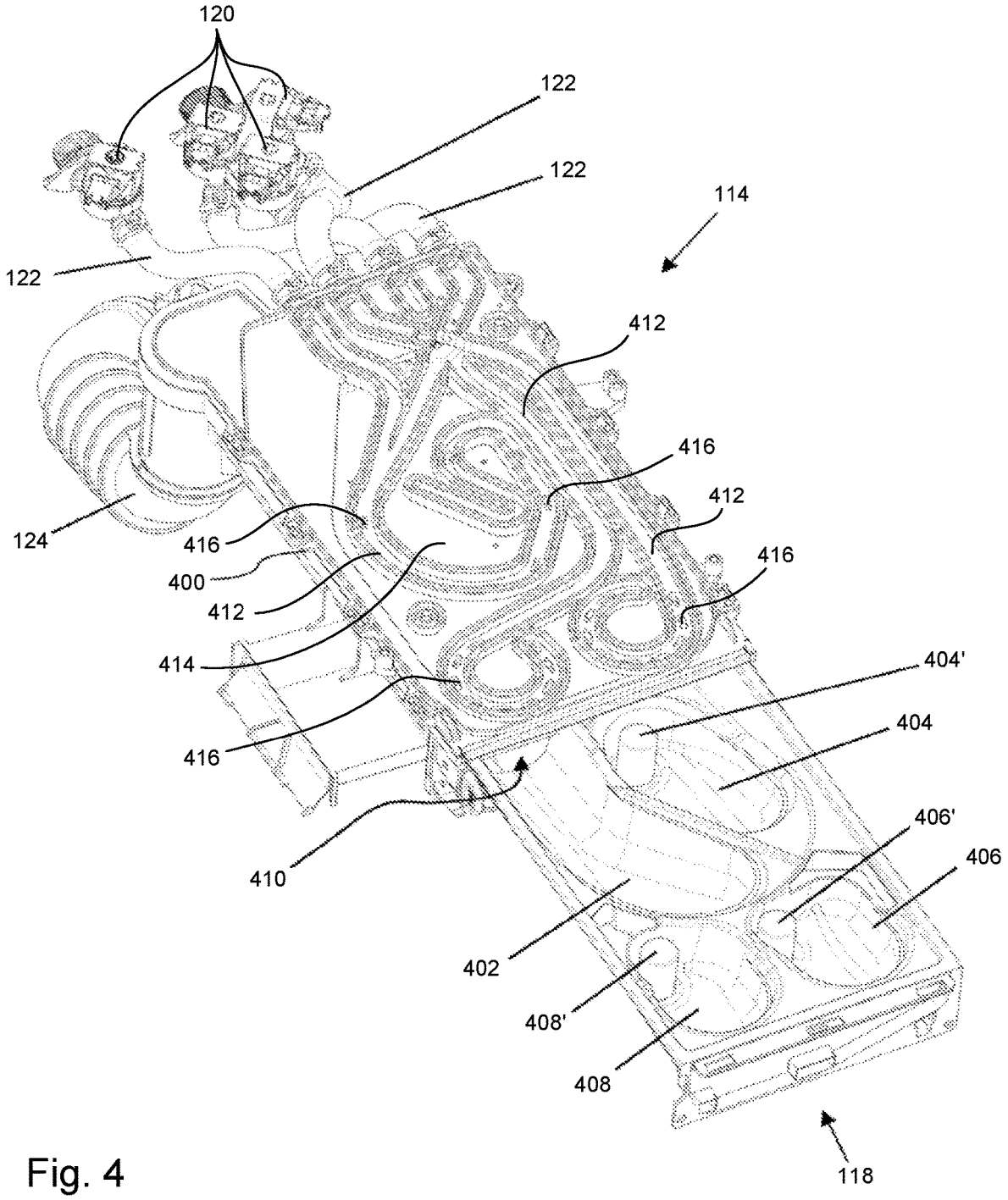
FIG. 4 is an isometric view of a treating agents dispenser of the laundry washing machine of FIG. 2, with a movable drawer in the opened position and a cover of the water distributor removed to view the fluid ducts therein.

FIG. 1 schematically illustrates a laundry washing machine 100 of the front loading variety. FIGS. 2 through 4 illustrate details of the embodiment of FIG. 1, as discussed in more detail below. The laundry washing machine 100 has an external housing or casing 102, in which a washing tub 104 is provided. The washing tub 104 contains a rotatable perforated drum 106 in which laundry 108 to be washed can be loaded. The washing tub 104 and the drum 106 both preferably have a generally cylindrical shape, and the drum 106 may include various internally-projecting or externally-projecting agitators or wash-enhancing structures, as known in the art. The casing 102 includes a door 200 (FIG. 2) that allows access to the drum 106 for loading and unloading laundry 108. A bellows 300 (FIG. 3) is provided around an open end of the tub 104 and drum 106 to form a water-tight seal with the casing 102 and the door 200, when the door 200 is closed, as known in the art. The washing tub 104 is preferably suspended in a floating manner inside the casing 102, such as by a number of springs and shock-absorbers (not illustrated). The drum 106 may be rotated by an electric motor 110 that is operatively connected to the drum 106 by a belt and pulley system 112 or other power transmission mechanisms (e.g., gears, chains, etc.). In some cases, the motor 110 can be directly connected to the drum 106 by a common shaft.

The laundry washing machine 100 includes an additive loading and supply system 114 that is connectable to a water supply system 116, such as household hot and cold water taps. The additive loading and supply system 114 and water supply system 116 preferably are in the upper part of the laundry washing machine 100, but other locations are possible. The additive loading and supply system 114 and water supply system 116 are structured to supply water and washing/rinsing products into the washing tub 104. Such cleaning products, as they are generically called, may include, for example, detergents, stain treatments, rinse additives, fabric softeners or fabric conditioners, waterproofing agents, fabric enhancers, rinse sanitization additives, chlorine-based additives, bleach, etc.

The additive loading and supply system 114 may include a dispenser tray with one or more compartments designed to be filled or loaded with washing and/or rinsing products.

Such compartments may include, for example, a main wash detergent compartment 114*a*, a stain treatment detergent compartment 114*b*, a bleach compartment 114*c*, and a fabric softener compartment 114*d*. The main wash detergent compartment 114*a* may be configured to receive powdered detergent and/or detergent contained in a dissolvable UDP. A liquid detergent cup may be provided that is adapted to be received in the main wash detergent compartment for loading and dispensing liquid detergent for the main wash phase. It will be appreciated that there may be more or fewer compartments in the additive loading and supply system 114 as may be appropriate for the desired feature level of the washer and in the market in which the washer will be sold.

The dispenser tray containing the compartments may be integrated into a movable drawer 118 or a removable container. For example, the additive loading and supply system 114 may comprise a sliding drawer having separate compartments for detergent, bleach and softener. Such a slidable drawer 118 is shown in the opened position in FIG. 2, and in the closed position in FIG. 3. Alternatively, the additive loading and supply system 114 may comprise one or more compartments that are fixed in place within the casing 102, and the casing 102 may include an openable door in the front of the washer or an openable lid in the top of the washer through the case 102. The additive loading and supply system 114 may also be located behind the door in a front load washer or under the lid in a top load washer. In such embodiments, the user can load detergent and the like into the additive loading and supply system 114 through the opened door.

The additive loading and supply system 114 also may be connected to one or more controllable supply valves 120 by one or more main inlet pipes 122 (it will be understood that the term "pipe" includes rigid pipes, flexible hoses, open channels, and any other structure configured to convey liquid from one location to another). The supply valves 120 are selectively operable to provide hot and/or cold water to one or more of the compartments. Where multiple compartments are used, the supply valves 120 may be operated separately or simultaneously to dispense fluid into and through each compartment, either individually or in one or more groups, as known in the art, in order to dispense each washing/rinsing product into the washing tub 104 at the appropriate time in the wash cycle. As the water provided by the water supply system 116 passes through the compartments, it combines with the contents of the compartments, thus forming a liquid cleaning solution.

The water supply system 116 is connected to the washing tub 104 by one or more tub supply pipes 124. For example, the tub supply pipe 124 may comprise a passage that terminates at a lateral side or lower portion of the tub 104, as shown in the example of FIG. 1. Alternatively the tub supply pipe 124 may connect to the bellows 300 or seal that connects the opening of the tub 104 to the casing 102. The tub supply pipe 124 also may connect to the washing tub 104 by way of the drum 106—e.g., by being connected to a bellows that feeds directly into the drum 106, and thus also fluidly communicates with the washing tub 104 via holes in the drum 106. As another alternative, the supply pipe 124 may connect to a reservoir, where the incoming liquid solution accumulates and may be heated or agitated before being pumped via a separate pump to the tub 104. In any case, the liquid solution may enter the tub 104 directly (e.g., enter through an outer wall of the tub 104), or indirectly (e.g., enter the tub 104 by way of the drum 106 or a reservoir). Other alternatives and variations will be apparent to persons of ordinary skill in the art in view of the present disclosure.

The composition of the liquid solution passing through the tub supply pipe 124 preferably can selectively contain one of the products contained in the compartments of the drawer 118, or such liquid solution can be clean water (i.e., water without added products), depending on the phase of the washing program and user preferences. For example, in the initial phases of the main washing phase of a wash cycle, a liquid detergent solution may be conveyed from the main wash detergent compartment 114*a* into the tub 104 by the incoming water, while in other phases, such as during a rinsing phase, only water is conveyed into the tub 104.

In an optional aspect of the present invention, a sump 126 may be provided at the bottom of the tub 104, to provide, among other things, a reservoir in which water and one or more products from the drawer compartments can be thoroughly dissolved, mixed and evenly dispersed (homogenized) in the water prior to being deposited on the laundry 108 in the drum 106. The wash liquid in the sump may also be heated to a sufficient temperature to fully activate the detergent prior to being deposited on the laundry 108 in the drum 106 for enhanced cleaning effectiveness. The volume of the sump 126 may be selected to completely hold an initial charge of the incoming wash liquid solution. The initial charge of water may be of a quantity sufficient to fill the drum 106 to a level at which wash solution is below the drum 106 and does not wet the laundry on the drum.

In the shown embodiment, the sump 126 is fluidly connected to a main outlet pipe 128, which leads to a filter 130. The filter 130 (which is optional), is provided to filter debris that might be harmful to the downstream pump or pumps from the liquid solution. Any suitable filter type may be used (e.g., paper, plastic or metal mesh, etc.). The outlet of the filter 130 may be connected to a first pipe 132 that leads to the inlet of a recirculation pump 134. The outlet of the recirculation pump 134 is connected to a recirculation pump outlet pipe 136 that leads back to the sump 126. Upon activation, the recirculation pump 134 draws liquid solution out of the sump 126 and then pumps it back into the sump 126, to thereby fully dissolve the detergent, and mix and homogenize the wash solution. A heater may also be provided in the sump (or other suitable location in the recirculation path) to assist with the process of activating the detergent or other active ingredients in the liquid solution.

The outlet of the filter 130 is also connected to a second pipe 138, which leads to the inlet of a distribution pump 140. The outlet of the distribution pump 140 is connected a distribution pump outlet pipe 142 that leads to the tub 104. Once the detergent has been substantially fully dissolved, homogenized and activated in the wash liquid in the sump, the distribution pump 140 is activated to convey the liquid solution from the sump 126 to an upper region of the drum 106, where the liquid solution is applied to the laundry 108 as the drum is rotated to wet the laundry with the wash liquid. The distribution pump outlet pipe 142 preferably is positioned to effectively distribute the liquid solution throughout the laundry 108. For example, it may lead to a tub inlet 302 located on an upper portion the bellows seal 300 surrounding the drum closure door 200, or the like, and there may be a spray nozzle on the outlet to spray the wash liquid on the laundry. An additional charge of water is supplied to the drum to raise the level of the wash liquid into the lower portion of the drum, such that as the drum is rotated the laundry is lifted by vanes in the drum out of the wash liquid and dropped back into the wash liquid.

The outlet of the filter 130 is also connected to a water draining system that is configured to drain the liquid solution, e.g., dirty water or water mixed with cleaning products and dirt, from the tub 104 and drum 106. For example, the water draining system may include a third pipe 144 that connects the outlet of the filter 130 to the inlet of a draining pump 146. The outlet of the draining pump 146 is fluidly connected to a main outlet pipe 148. Upon activation, the draining pump 146 conveys liquid solution from the sump 126 to the main outlet pipe 148. The main outlet pipe 148 is configured to be fluidly connected to a household draining pipe system (not illustrated).

The first pipe 132, second pipe 138 and third pipe 144 are shown as being fluidly separate from one another, but it will be appreciated that they may be fluidly connected as branches of a common fluid passage. It will also be appreciated that each of the pumps 134, 140, 146 may have its own separate filter or one or more may not have a filter. Also, the main outlet pipe 128 may be directly connected to the draining pump 144, rather than passing through the filter.

In other embodiments, one or both of the recirculation pump 134 and the distribution pump 140 (as well as the associated fluid paths) may be omitted. For example, both pump 134, 140 may be omitted, and the tub supply pipe 124 may lead directly to a drum inlet 302 located at the top of the bellows door seal 300. As another example, the recirculation pump 134 may be omitted, but the distribution pump 140 may remain to pump the detergent from the sump 126 to the top of the drum 106. Other alternatives and variations will be apparent to persons of ordinary skill in the art in view of the present disclosure.

The laundry washing machine 100 may be advantageously provided with one or more liquid level sensors 150 (schematically illustrated in FIG. 1) configured to sense or detect the liquid level inside the tub 104 as is well understood in the art. The level sensor 150 may comprise, for example, a pressure sensor that is acted upon by the liquid in the tub 104 to provide a sensor signal indicative of the liquid level of the wash water and/or the foam level contained in the tub 104. In some cases, the pressure sensor may be fluidly connected with a draining sump of the water draining system. The level sensor 150 also may comprise a mechanical, electro-mechanical, electrical, or optical fluid level measuring system, etc. Such devices are known in the art (e.g., floats, capacitance sensors, etc.) and need not be described in detail herein.

The laundry washing machine 100 also includes a control unit 152. The control unit 152 includes hardware and software configured to operate the laundry washing machine. In one example, the control unit 152 includes one or more processors that are programmed to execute machine-readable code stored on one or more memory devices. A typical processor may be a central processing unit (CPU), a microprocessor, an application-specific integrated circuit (ASIC), and so on. Memory devices may be provided as random access memory (RAM) for temporary data storage, read only memory (ROM) for permanent data storage, firmware, flash memory, external and internal hard-disk drives, and the like. The processor communicates with the memory device via a communication bus or the like to read and execute computer-readable instructions and code stored in a non-transient manner in the memory devices. The incorporation of control units into laundry washing machines is well-known in the art and the details of the control unit 152 need not be explained in more detail herein.

The control unit 152 is operatively connected to the various parts of the laundry washing machine 100 in order to control its operation. The control unit 152 preferably is operatively connected to: the electric motor 110 so that the drum speed may be controlled; the controlled supply valves 120 so that the water supplied to the drawer 118 is controlled; and to the pumps 134, 140, 146 to control their respective operations. The control unit also may be connected to the level sensor 150 to determine a level of water and/or foam inside the tub 104, a load weight measuring system, one or more water temperature sensors, lockout switches (e.g., a switch that prevents operation if the loading/unloading door 200 is opened), and so on. The control unit 152 also may be configured to perform unbalanced laundry checks to verify whether the laundry 108 loaded in the drum 106 is balanced or not, and to perform various conventional operations.

The operative connections between the control unit 152 and the remaining parts (shown schematically by dashed lines) may be by electrical wires, wireless communication, and the like. Suitable control devices (e.g., solenoids to operate valves, motor controllers, etc.) are provided to allow the control unit 152 to operate the various components. Conventional fuses, power converters, and other ancillary features also may be included as necessary or desired.

The control unit 152 is also operatively connected to a user interface 154 that is accessible to the user. The user interface 154 is configured to allow the user to select and set the washing parameters, for example by selecting a desired washing program. The user interface 154 also may be configured to allow the user to input other operating parameters, such as the washing temperature, the spinning speed, the load in terms of weight of the laundry to be washed, the type of fabric of the load, etc.

The user interface 154 may comprise any suitable arrangement of input and output mechanisms. For example, input may be provided by one or more dials, switches, buttons, touchscreens, or the like, and output may be provided by one or more position markers, textual or graphic images, illuminable lights or displays, touchscreens, and so on. In one example, the user interface includes a display 154*a*, power button, a rotatable operation program selection dial 154*b* that selects among pre-set operation programs (e.g., sanitary cycle, light load, heavy load, etc.), and a number of operation program adjustment buttons that can be operated to modify aspects of the pre-set operation programs (e.g., temperature adjustment, time adjustment, spin speed adjustment, etc.). One input may comprise a dedicated UDP or Pod cycle input 154*c* button or selector.

The control unit 152 is configured to operate the various parts of the laundry washing machine 100 to effectuate the pre-set operation programs, and to make adjustments to these operation programs based on user input. The control unit 152 also may use sensor feedback to modify the cycles and variables for each pre-set operation program. For example, the control unit 152 may change the volume of water used during a particular load cycle based on detecting a load weight above a certain value. As another example, the control unit 152 may reduce the spin speed of a particular spin cycle if a balance indicator (e.g., an accelerometer or the like) indicates excessive vibration. Other alternatives and variations will be apparent to persons of ordinary skill in the art in view of the present disclosure.

FIG. 4 illustrates features of the additive loading and supply system (or additive supply system) 114 and related components, including the valves 120, main inlet pipes 122, drawer 118, and tub supply pipe 124. The additive loading and supply system 114 includes the drawer 118, which is slidingly received within a drawer housing 400. The exemplary drawer 118 includes a main wash compartment 402, and may include additional compartments, such as a second compartment 404, a third compartment 406, and a fourth compartment 408, as previously described.

The first or main wash compartment 402 is configured to receive powdered detergent, liquid detergent with the insertion of an inset cup, or detergent provided in a UDP form for the main wash phase of a wash cycle. In particular, the main wash compartment 402 is sized to receive UDPs having one or more shapes and sizes. The main wash compartment 402 has an open rear end to allow powder detergent or the UDP to move out of the main wash compartment 402, through a funnel, into the supply pipe 124 and to the tub. The main wash compartment may be in the form of a trough (e.g. gutter) formed in the bottom internal wall of the drawer housing 400 that slopes downward to the funnel/tub supply pipe 124 located adjacent the rear end of the bottom wall.

The additional compartments 404, 406, 408 are configured to receive liquid additives (e.g., liquid detergent, fabric softener, fabric conditioners, waterproofing agents, fabric enhancers, rinse sanitization additives, chlorine-based additives, bleach, etc.). Each additional compartment has a respective siphon tube 404', 406', 408' that empties into the space between the bottom internal wall of the drawer housing and a lower external wall of the drawer housing. The external lower wall slopes downward toward a read end of the drawer housing and the lower outer wall, to allow liquid additives to move out of the drawer housing, through the funnel and the supply pipe 124, and into the tub. The funnel for the liquid additives may be the same as the one provided for the dry detergent, but separate funnels may be used if desired.

Dry detergent, UDPs and liquid additives are moved from their respective compartments to the tub supply pipe 124 by activating the appropriate valves 120 to create water flows to move the additives. In the illustrated example, the valves 120 are fluidly connected to a plurality of fluid ducts 412 located in the upper wall 414 of the drawer housing 400. The ducts 412 include respective outlet ports 416 that direct incoming hot and/or cold water to one or more of the compartments. The outlet ports 416 may have any desired configurations and positions. The ducts 412 are shown for clarity in FIG. 3 as being open to the top, but in normal use they preferably are sealed from above by a cover 304 (FIG. 3) to prevent leakage.

Selective operation of the valves 120 can be implemented to direct fluid to the desired compartment at the desired time, as known in the art. Water directed to the main wash detergent compartment 402 causes the main wash detergent or UDP to move through the outlet 410 and into the tub supply pipe 124. To this end, the bottom wall of the main wash compartment 402 may be sloped downwards towards the outlet 410. Such slope may be selected such that powdered detergent or a UDP does not move through the outlet 410 until water is provided into the main wash compartment. In those cases in which a liquid detergent is desired to be added to the compartment, a removable cup having a siphon (not shown) may be provided to hold the liquid detergent and prevent it from flowing through the outlet 410. Water directed to the liquid additive compartments 404, 406, 410 (or to compartment 402 when a liquid cup is used) accumulates in those compartments until the liquid level is high enough to enter the respective siphon 404', 406', 408', resulting in ejection of the liquid through the siphon 404', 406', 408'.

As noted above, it is known from the Applicant's prior work to configure a compartment such as the main wash compartment 402 to have features for actively breaking open a UDP. For example, one or more of the outlets 416 may be configured to generate water jets that penetrate the UDP's outer pouch. It is also known from the Applicant's prior work that a UDP that is not actively broken open (either by a failure of the water jets or simply an absence of the water jets from the device) may progress to a sump 126 where it is opened by conventional dissolution of the water-soluble outer pouch. While those configurations and machine functionalities are both useful, it has been found that other alternatives may be provided for reliably breaking open and dissolving the UDP pouch, particularly by holding the UDP pouch in a soaking chamber that is filled partially or completely with water.

Figure 5:
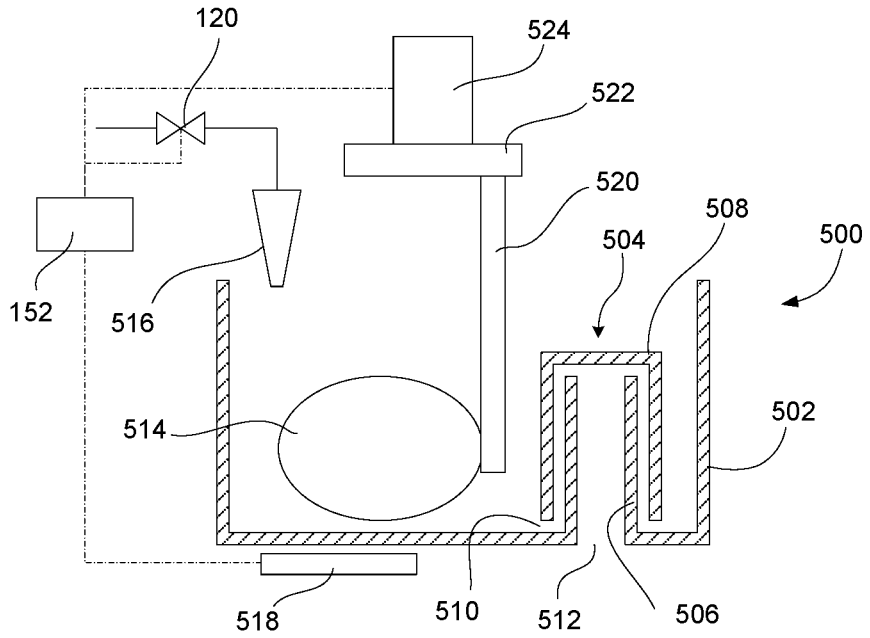
FIG. 5 is a schematic illustration of an embodiment of a laundry washing machine additive loading and supply system having a UDP soaking chamber.

Referring now to FIG. 5, in one embodiment, a soaking chamber 500 may comprise a receptacle 502 having a siphon 504 extending into it. The siphon 504 may have any suitable shape. In the shown embodiment, the siphon 504 is formed by a siphon tube 506 that extends upwards from a hole passing through the bottom of the receptacle 502, and a siphon cap 508 that surrounds the siphon tube 506. The siphon cap 508 forms a passage from the top of the siphon tube 506 to a point near the bottom of the receptacle 502. Together, the siphon tube 506 and siphon cap 508 form a continuous closed passage that extends from a siphon inlet 510 located near the bottom of the receptacle 502 to a siphon outlet 512. The top of the siphon tube 506 forms the highest internal point of this siphon passage. Thus, it will be understood that the siphon 504 is configured to siphon liquid in the receptacle 502 into the siphon inlet 510 and out through the siphon outlet 512 once the liquid level in the receptacle 502 reaches the level of the top of the siphon tube 506, as known in the art.

It will be understood that other kinds of siphons 504 may be used. For example, an inverted U-shaped tube may extend over a sidewall and into the receptacle 502 to locate a siphon inlet near the bottom of the receptacle. Other alternatives and variations will be apparent to persons of ordinary skill in the art in view of the present disclosure.

The receptacle 502 is configured to receive a UDP 514 and a supply of liquid (e.g., cold and/or warm water) from an inlet nozzle 516. To this end, the receptacle 502 may be dimensioned to have an open internal space that is larger than a typical UDP 514 (e.g., about 1 to 1.5 inches square, and 1 inch tall). If necessary, the siphon 504 may be located at or near one sidewall of the receptacle, such as shown, but this is not required.

Water may be provided to the inlet nozzle 516 by a valve 120 under the control of a control unit 152, or by other mechanisms as known in the art. When the water level in the receptacle 502 reaches the highest internal point of the siphon 504 (e.g., the top of the siphon tube 506, the water and other contents of the receptacle will begin siphoning out through the siphon 504.

In use, a UDP 514 is loaded into the receptacle 502, and the control unit 152 activates the valve 120 to direct a first volume of liquid through the nozzle 516 and into the receptacle 502. As the water contacts the UDP 514, it reacts with and begins to dissolve the UDP pouch material. This reaction continues while the UDP pouch is in contact with water. Eventually, the pouch will break open to release the contents of the UDP into the receptacle with the water, at which point the contents of the pouch dissolve in or homogenize with the water in the receptacle 502. The UDP pouch also continues to dissolve, preferably (but not necessarily) until it is completely dissolved.

After the UDP 514 reaches the desired level of dissolution in the water, the control unit 152 operates the valve 120 to provide a second volume of water through the nozzle 516 to raise the water level above the highest internal point of the siphon 504. Thus, the contents of the receptacle 502 begin siphoning out of the receptacle 502 to be used in a laundry washing process. The contents continue to siphon out until the valve 120 is closed and the liquid level in the receptacle 502 drops below the siphon inlet 510.

In the foregoing example, the control unit 152 may close the valve 120 for a period of time after the water level in the receptacle 502 has reached a point that is sufficient to wet some or all of the UDP pouch material, but below the siphon's highest internal point 504, to provide a first quantity of water. This provides a soaking period in which the water dissolves the UDP's pouch and contents. However, it is also envisioned that the dissolution rate of the UDP pouch and contents may, in some cases, be relatively high and/or the flow rate into the receptacle 502 may be relatively low, such that the valve 120 can remain open continuously until siphoning begins, while still obtaining suitable dissolution of the UDP pouch and contents. In this case, the first volume of liquid that is passed through the valve 120 and into the receptacle 502 to dissolve the UDP 514 is essentially continuous with the second volume of liquid that is passed through the valve 120 to cause the contents of the receptacle 502 to pass through the siphon 504. The desired amount of time—i.e., the soaking period—between initial wetting of the UDP 514 and providing the second volume of liquid (i.e., initiating siphoning) may be determined empirically.

As noted above, the siphon's highest internal point may be selected to help obtain a desirable amount of dissolution of the UDP. For example, the highest internal point within the siphon 504 may be provided at a height H from the bottom of the receptacle 502 that is equal to or greater than the average height of the UDP 514. The height may be selected based on a particular UDP 514 (i.e., a particular brand of UDP designated for use with the machine), an average of UDPs available on the market, and so on. Providing the height H at or above the UDP height helps ensure that the entire UDP pouch surface is wetted by the water as soon as possible to start a uniform dissolution process.

In some cases, complete wetting may not occur during the initial wetting. For example, the UDP 514 might begin to float, leaving the uppermost floating surfaces dry. This may be mitigated by locating the nozzle 516 where it will wet the top of the UDP. In any event, as the portions of the UDP 514 located in the water begin to dissolve, the un-wetted portions eventually sink into contact with the water to be dissolved.

The soaking chamber 500 may include features or be designed to prevent undissolved portions of UDP pouches from blocking the siphon inlet 510 or clogging the siphon passage. For example, the siphon inlet may comprise a perforated opening or a series of spaced holes, or be surrounded by a mesh or filter that prevents large pieces of undissolved UDP pouch material from passing therethrough.

The soaking chamber 500 also may include other features to help assist with breaking open and dissolving the UDP 514. For example, a heating element 518 may be provided in or near the soaking chamber 500 to raise the temperature of the water and liquid solution to help dissolve and homogenize the UDP 514 with the water. The heating element 518 may be a resistive heater, a Peltier device, and so on, as known in the art, and it may be controlled by the control unit 152. The heating element 518 also may be a pre-existing component of a washing machine, such as a sump water heater that is located near the soaking chamber 500.

A mechanical agitator also may be used in conjunction with a soaking chamber 500. For example, a mixing rod 520 may extend into the receptacle 502 to stir the contents of the receptacle. The mixing rod 520 may be mounted on a rotatable plate 520 at a point that is offset from the plate's center of rotation, and the plate driven by a motor 522 under control of the control unit 152, to thereby cause the rod 520 to move in a circular stirring pattern. Other mechanical agitators also may be used. For example, the mixing rod 520 may be replaced by one or more blades or pins that contact the UDP 514 to assist with breakage, or the receptacle 502 may include a recirculation pump to mix the contents. Alternatives to the mixing rod 520 will be readily envisioned based on this disclosure. For example, the mixing rod 520 may be replaced by an agitator (rod, disc, blades, vanes, etc.) located in the bottom or side wall of the compartment, or it may be replaced by a recirculating pump. Combinations of devices also may be used.

In still other embodiments, a hydraulic agitator may be provided to assist with breaking open the UDP 514. For example, the nozzle 516 may be formed as a laminar flow jet that generates a concentrated flow of water against the UDP 514 to help pierce the UDP pouch, or such concentrated flow may be directed into the water to generate a stirring motion. Other alternatives and variations will be apparent to persons of ordinary skill in the art in view of the present disclosure.

As noted above, the receptacle 502 preferably is at least large enough to receive a conventional UDP 514. Thus, the entire UDP 514 can be surrounded by water for dissolution. The receptacle 502 also may be made large enough to ensure that the volume of water in the receptacle 502 does not become saturated and unable or inefficient to continue dissolving the UDP pouch and/or contents. The receptacle 502 also may be sized to provide a pre-wash mixing chamber for a relatively large volume of liquid solution, for example, comparable to the volume of a sump 126, to provide more complete mixing and homogenizing of the water and detergent prior to applying the liquid solution to the laundry.

Figure 6:
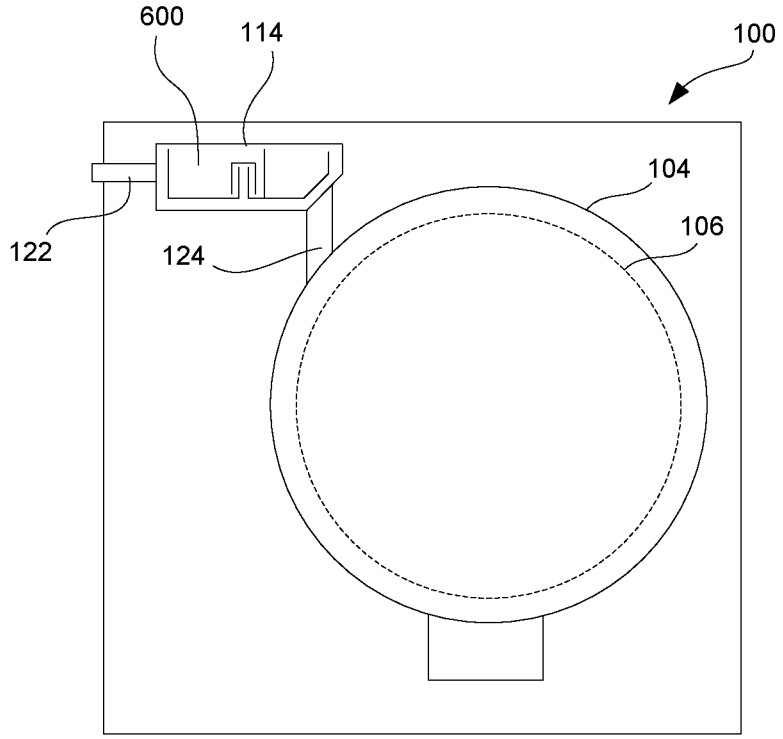
FIG. 6 is a schematic illustration of an embodiment of a laundry washing machine having a UDP soaking chamber.

A soaking chamber such as described herein may be located at any suitable position within the laundry washing machine. Referring to FIG. 6, in one embodiment, the soaking chamber 600 is located within an otherwise conventional additive loading and supply system 114. For example, the additive loading and supply system 114 may comprise a drawer, such as described in relation to FIG. 4, having multiple compartments for receiving different additives. One compartment may be dimensioned and configured as a soaking chamber 600 having a receptacle and siphon, such as described above in relation to FIG. 5. The soaking chamber 600 may be a dedicated compartment that is intended only for use with UDPs, or it may be multipurpose compartment that may also be used with loose additives. For example, the soaking chamber 600 may be a compartment that is provided for adding fabric softener in either liquid or UDP form. As another example, the detergent compartment 114*a* may be divided into a loose detergent compartment and a fluidly separate soaking chamber 600. It will also be understood that the additive loading and supply system 114 need not be provided as a sliding drawer, and may instead comprise a compartment that is accessed via an openable wall or panel through the outer casing of the machine. Other alternatives and variations will be apparent to persons of ordinary skill in the art in view of the present disclosure.

Figure 7:
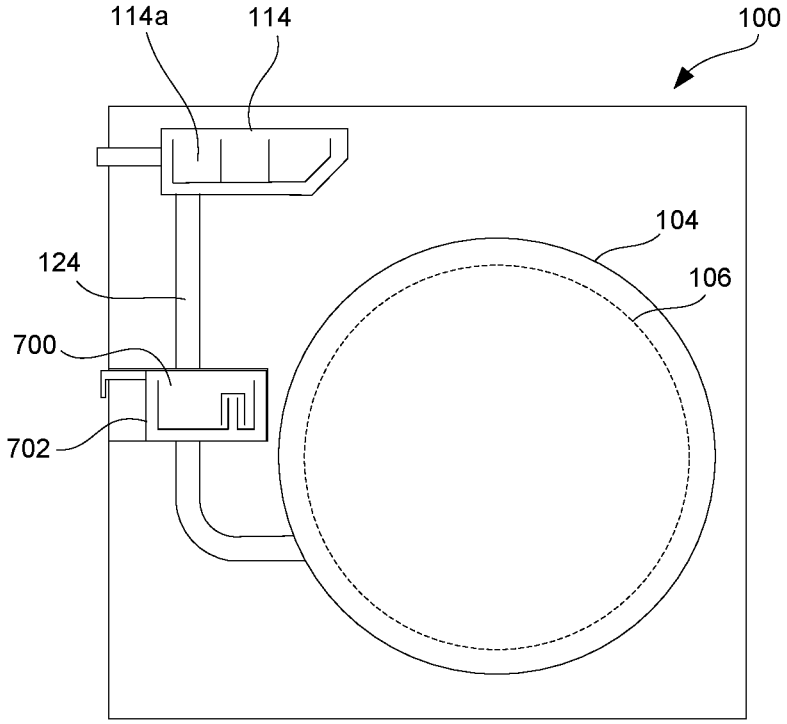
FIG. 7 is a schematic illustration of another embodiment of a laundry washing machine having a UDP soaking chamber.

Referring to FIG. 7, in other embodiments, a soaking chamber 700 may be provided separately from the remaining additive loading and supply system 114. In this example, the soaking chamber 700 is provided in the tub supply pipe 124 extending from the additive loading and supply system 114 to the tub 104. The soaking chamber 700 also may be upstream of the additive loading and supply system 114.

In this example, the soaking chamber 700 may be accessible or openable to directly place the UDP into the soaking chamber 700. For example, the soaking chamber 700 may be mounted to a separate drawer 702 that may be removed to add a UDP to the soaking chamber 700. As another example, the soaking chamber 700 may be accessed via a panel or door that is opened to drop the UDP into the soaking chamber 700.

Alternatively, the soaking chamber 700 may be indirectly loaded by loading the UDP into the laundry washing machine 100 at some other location, and then conveying the UDP to the soaking chamber 700. For example, the additive loading and supply system 114 may have a detergent compartment 114*a* that has an outlet (e.g., outlet 410 in FIG. 4) that is dimensioned to allow an undissolved UDP to pass therethrough and down the tub supply pipe 124 to fall into the soaking chamber 700.

In this example of FIG. 7, the contents of the additive loading and supply system 114 all pass through the soaking chamber 700 to get to the tub 104. When it is desired to supply non-UDP contents of the additive loading and supply system 114 to the tub 104, it may be necessary to provide sufficient volume of water flow to ensure that the non-UDP contents fully pass through the soaking chamber 700. For example, when adding liquid fabric softener from a siphon-type fabric softener compartment 114*c* such as described above in relation to FIG. 4, it is necessary to supply sufficient water to cause the mixture of water and fabric softener to pass through the siphon in the fabric softener compartment 114*c*, and then subsequently through the siphon in the soaking chamber 700.

Figure 8:
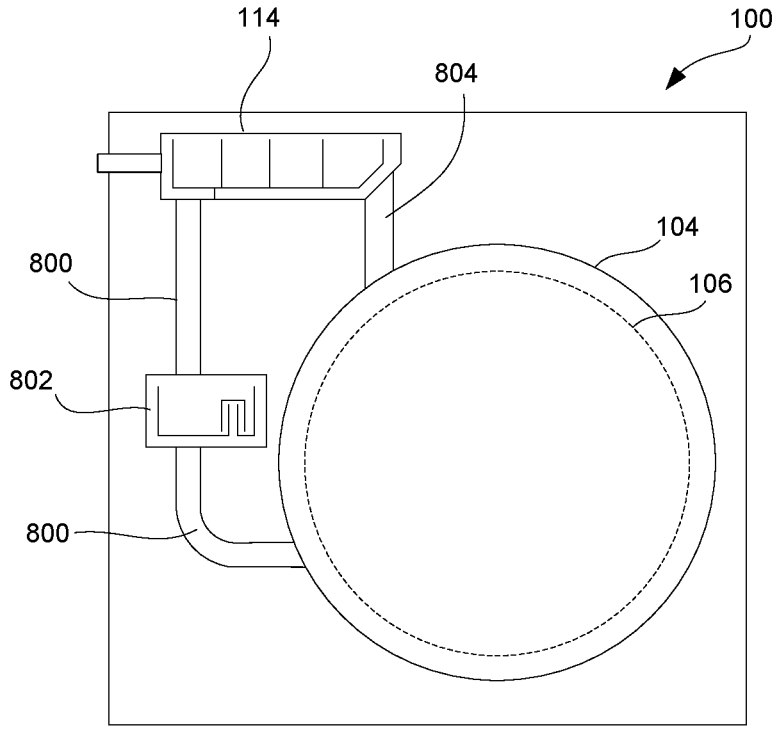
FIG. 8 is a schematic illustration of another embodiment of a laundry washing machine having a UDP soaking chamber.

FIG. 8 illustrates a variation on the embodiment of FIG. 7, in which the additive loading and supply system 114 is constructed such that one or more of the compartments feed into a first tub supply pipe 800 leading to a soaking chamber 802, and one or more other compartments feed into a second tub supply pipe 804 that bypasses the soaking chamber 802. The second tub supply pipe 804 may take any fluid path to bypass the soaking chamber 802, such as by leading directly to the tub 104 or leading to a portion of the first tub supply pipe 800 located downstream of the soaking chamber 802.

In other embodiments, the laundry washing machine may have a soaking chamber that is selectively moved into the tub supply pipe 124, such that it is only used when a UDP is to be dissolved.

Figure 9:
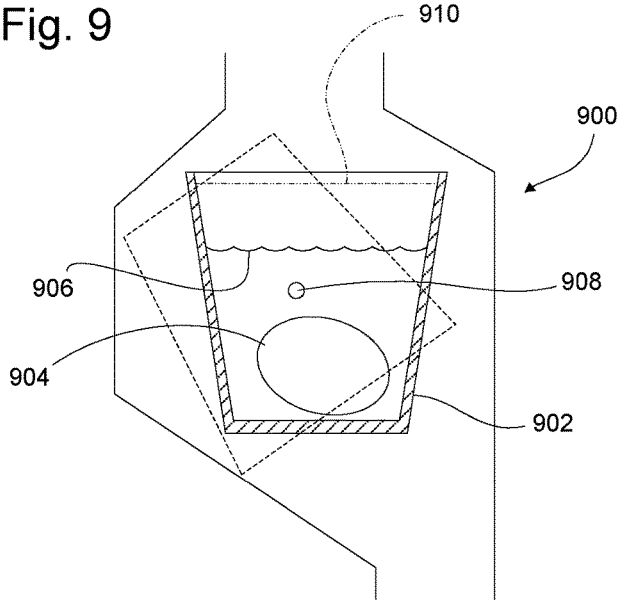
FIG. 9 is a schematic illustration of another embodiment of a laundry washing machine UDP soaking chamber.

FIG. 9 illustrates another embodiment of a soaking chamber 900. In this example, the soaking chamber 900 comprises a receptacle 902 that is configured to receive a UDP 904 and a first volume of water 906. The UDP 904 may be loaded directly or indirectly, such as described above. The water 906 may be added by any suitable supply, such as a nozzle located in an upstream additive loading and supply system 114, or a separate nozzle located adjacent to the receptacle 902.

The receptacle 902 is configured to remain in a first, upright, position to hold the UDP 904 and water 906 for a predetermined amount of time to allow the water 906 to break open and at least partially dissolve the contents of the UDP 904 to form a liquid solution, then subsequently allow the liquid solution to pass downstream to be used in the tub for cleaning laundry. To this end, the receptacle 902 is mounted on a pivot 908 that allows the receptacle to tilt over when the combined center of gravity of the receptacle 902 and its contents rises above the level of the pivot 908. For example, when the water reaches a predetermined level 910 the combined center of gravity rises above the pivot 908. At this point, any movement of the combined system will cause the receptacle 902 to tilt over to a second position (broken lines) and release its contents. Once the liquid solution is released, the center of mass of the empty receptacle 902 is offset from the pivot 908 to cause the receptacle to swing back to the upright position.

If desired, the pivot 908 may be offset in one direction relative to the volumetric center of the receptacle 902, such as shown, to allow tilting only in one direction. Travel stops also maybe provided to control the receptacle's movement.

The receptacle 902 is shown having a tapered inner volume that is wider at the top, which can be useful to make the overall vertical size smaller and encourage complete emptying of the receptacle 902 when it tilts. The inner volume may be rectilinear (e.g., rectangular or square when viewed from above), circular (e.g., a conic section), or have other shapes.

The foregoing soaking chamber 900 may be used by supplying a first volume of water 306 that is sufficient to soak the UDP 904 and begin dissolution, but is just below the tipping point. After the desired soaking time, a second volume of water is added to raise the total liquid solution level to the tipping point 910, and the contents are released to transfer the liquid solution to the tub. If desired additional fillings may be performed to cause the receptacle 902 to repeatedly tip over, to ensure that all of the UDP contents are released.

Figure 10:
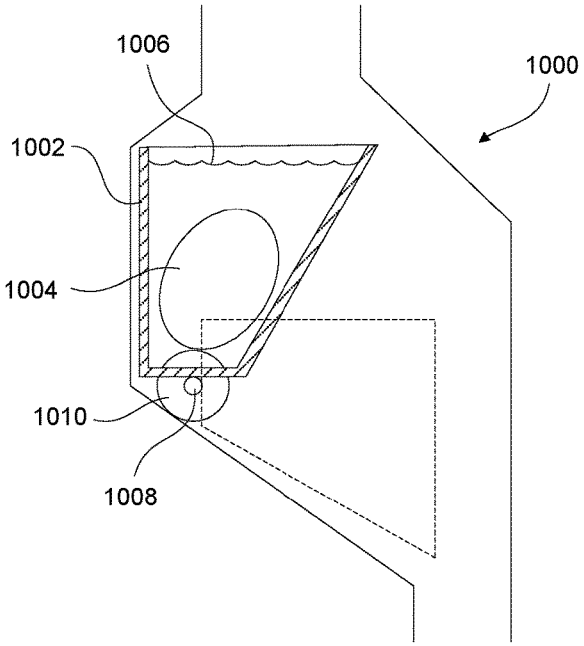
FIG. 10 is a schematic illustration of another embodiment of a laundry washing machine UDP soaking chamber.

FIG. 10 shows another embodiment of a soaking chamber 1000. In this example, the soaking chamber 1000 comprises a receptacle 1002 that is configured to receive a UDP 1004 and a volume of water 1006. As with the previous embodiment, the UDP 1004 may be inserted directly into the receptacle 1002 via a door or the like, or indirectly into the receptacle 1002 such as by using a flow of water to flush the UDP 1004 down from an additive loading and supply system (e.g., additive supply system 114).

The receptacle 1002 is movable between a first position and a second position. In the first position, which is shown in solid lines in FIG. 10, the receptacle 1002 holds the UDP 1004 and water 1006 while the water 1006 breaks open the UDP 1004 and dissolves or mixes with its contents. In the second position, shown in broken lines, the receptacle 1002 is tilted over to allow the liquid solution formed by the water 1006 and dissolved portions of the UDP 1004, as well as any remaining solid pieces of the UDP 1004, to fall down a tub supply pipe 124 to be conveyed to the tub or some intermediate destination.

The receptacle 1002 may be moved between the first position and the second position using any suitable mechanism. For example, in the shown embodiment, the receptacle 1002 is mounted on a pivot 1008, which connected directly to an output shaft of an electric motor 1010. In other embodiments, the linkage between the electric motor 1010 and the pivot 1008 may include gears, belts, multiple-bar linkages, sliders, cams, and so on, as known in the art of mechanics. The motor also may be replaced by a solenoid that pushes on the receptacle or on a lever arm attached to the pivot 1008, or by other mechanisms. One of more springs also may be provided to bias the receptacle 1002 to the first position or the second position, as desired. Other alternatives and variations will be apparent to persons of ordinary skill in the art in view of the present disclosure.

Figure 11:
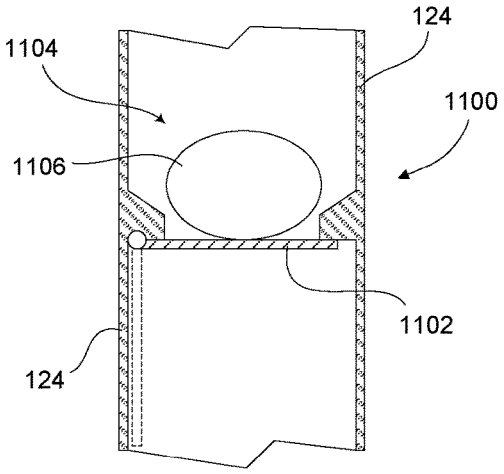
FIG. 11 is a schematic illustration of another embodiment of a laundry washing machine UDP soaking chamber.

FIG. 11 shows another embodiment of a soaking chamber 1100. In this embodiment, the soaking chamber 1100 is formed by a portion of the tub supply pipe 124 located upstream of a valve 1102. The valve 1102 is movable between a first, closed, position (shown in solid lines) in which the valve 1102 blocks the tub supply pipe 124, and a second, open, position (broken lines) in which the valve 1102 does not block the tub supply pipe 124.

In the first position, the valve 1102 cooperates with the upstream portion of the tub supply pipe 124 to form a chamber 1104 to receive a UDP 1106. The UDP 1106 may be deposited directly into this chamber 1104, but more preferably is indirectly deposited into the chamber 1104 by being flushed from a separate upstream receptacle (e.g., additive supply system 114) by a flow of water. Water is also added to the chamber 1104, either before, with, or after the UDP 1106, using one or more valves and nozzles, such as described above.

The valve 1102 remains in the first position until the water breaks open the UDP and at least partially dissolves and mixes with UDP's contents for form a liquid solution. At this time, the valve 1102 moves to the second position to allow the liquid solution and an undissolved portions of the UDP to continue down the tub supply pipe 124. The valve 1104 may be operated by a control unit 152 that operates a motor (electric, hydraulic, pneumatic, etc.), a solenoid, and so on. One or more springs may be provided to bias the valve 1102 to the first or second position.

The valve 1102 may be any suitable type of valve that provides a seal sufficient to hold the UDP 1106 and water until proper dissolution has been achieved. For example, the valve 1102 may comprise a flapper valve (such as shown), a ball valve, a butterfly valve, a rotating or sliding gate valve, and so on. The valve 1102 also may be formed by flexible walls of the tub supply pipe 124 that are selectively pinched together (e.g., between cams or rollers) to prevent flow through the supply pipe 124.

Also, the valve 1102 is not strictly required to seal across the entire width of the tub supply pipe 124. For example, the valve 1102 may comprise a movable weir that selectively blocks the lower portion of a horizontal or sloping portion of the tub supply pipe 124, so that water and the UDP 1106 may be retained upstream of the weir until the weir is moved away to allow the liquid solution to pass. As another example, the valve 1102 may comprise a portion of the tub supply pipe 124 that is selectively raised to form an incline over which the water and UDP 1106 cannot flow until it is lowered again.

In other embodiments, the soaking chamber 1100 may be provided as a separate assembly that is spliced into a tub supply pipe 124 between the additive loading and supply system 114 and the tub 104. As another alternative, the soaking chamber 1100 may be located in a separate fluid path between the additive loading and supply system 114 and the tub 104, such as described in relation to FIG. 8.

It will be appreciated that the various embodiments of soaking chambers described herein may be provided at any suitable location within a laundry washing machine, such as within an otherwise conventional additive loading and supply system, in the fluid path from an additive loading and supply system to the tub, in an internal chamber within the laundry washing machine, in a separate additive supply chamber (drawer or openable receptacle), and so on. Other alternatives and variations will be apparent to persons of ordinary skill in the art in view of the present disclosure.

The present disclosure describes a number of inventive features and/or combinations of features that may be used alone or in combination with each other or in combination with other technologies. The embodiments described herein are all exemplary, and are not intended to limit the scope of the claims. It will also be appreciated that the inventions described herein can be modified and adapted in various ways, and all such modifications and adaptations are intended to be included in the scope of this disclosure and the appended claims.

The invention claimed is:

1. A method for operating a laundry machine, the method comprising:

receiving a unit dose package comprising a water soluble pouch containing a dose of cleaning product in a soaking chamber;

operating a processor to provide a first quantity of liquid to the soaking chamber;

operating the processor to allow the first quantity of liquid and the unit dose package to remain in the soaking chamber for a predetermined amount of time sufficient to at least partially dissolve the unit dose package; and operating the processor to release a solution from the soaking chamber into a washing tub after the predetermined amount of time has elapsed, the solution including an entirety of the unit dose package and at least the first volume of liquid.

2. The method of claim 1, further comprising:

operating the processor to provide a second quantity of liquid to the soaking chamber, the second quantity of liquid being sufficient to cause the first quantity of liquid and the second quantity of liquid to siphon out of the soaking chamber into the washing tub.

3. The method of claim 1, further comprising:

operating the processor to provide a second quantity of liquid to the soaking chamber, the second quantity of liquid being sufficient to cause the first quantity of liquid and the second quantity of liquid to pour out of the soaking chamber into the washing tub.

4. The method of claim 1, further comprising:

operating the processor to rotate the soaking chamber to allow the first quantity of liquid and the second quantity of liquid to pour out of the soaking chamber into the washing tub.

5. The method of claim 1, further comprising:

operating the processor to open a valve to allow the first quantity of liquid to pour out of the soaking chamber into the washing tub.

6. The method of claim 1, further comprising:

operating the processor to provide a second quantity of liquid to the soaking chamber, the second quantity of liquid being sufficient to cause the soaking chamber to tip over and pour the first quantity of liquid and the second quantity of liquid into the washing tub.

7. The method of claim 1, further comprising:

operating the processor to cause one or more supply valves to supply a second volume of liquid to the soaking chamber after the predetermined amount of time has elapsed in order to release the solution from the soaking chamber into the washing tub, the solution including the entirety of the unit dose package, at least the first volume of liquid and the second volume of liquid.

8. The method of claim 1, further comprising:

operating the processor to cause an agitator to stir the solution in the soaking chamber prior to releasing the solution into the washing tub.

9. The method of claim 1, further comprising:

operating the processor to provide the unit dose package into the soaking chamber from an additive loading and supply system.

10. The method of claim 1, further comprising:

operating the processor to release the first quantity of liquid into the washing tub through a tub supply pipe connecting the soaking chamber to the washing tub.

* * * * *